US007128189B2

(12) United States Patent
Maury et al.

(10) Patent No.: US 7,128,189 B2
(45) Date of Patent: Oct. 31, 2006

(54) EQUIPMENT FOR ENGAGING A SAFETY BRAKING DEVICE FOR A LIFT CAGE

(75) Inventors: Julien Maury, Lucerne (CH); Stefan Hugel, Adligenswil (CH); Peter Aeschlimann, Sursee (CH)

(73) Assignee: Inventio AG, Hergiswil (CH)

( * ) Notice: Subject to any disclaimer, the term of this patent is extended or adjusted under 35 U.S.C. 154(b) by 556 days.

(21) Appl. No.: 10/427,855

(22) Filed: May 1, 2003

(65) Prior Publication Data

US 2003/0226718 A1 Dec. 11, 2003

(30) Foreign Application Priority Data

May 2, 2002 (EP) ..... 02405356

(51) Int. Cl.
*B66B 5/04* (2006.01)

(52) U.S. Cl. ..... 187/373; 187/370; 187/374; 187/375; 187/376; 188/187; 188/188; 188/189

(58) Field of Classification Search ..... 187/373, 187/374, 375, 376, 370; 188/187, 188, 189
See application file for complete search history.

(56) References Cited

U.S. PATENT DOCUMENTS

| | | | | |
|---|---|---|---|---|
| 1,678,031 | A * | 7/1928 | Anderson | 187/376 |
| 1,789,008 | A * | 1/1931 | Lindquist | 187/265 |
| 1,803,762 | A * | 5/1931 | Alexander | 187/376 |
| 1,875,118 | A * | 8/1932 | Ohler et al. | 187/376 |
| 3,762,512 | A * | 10/1973 | McIntyre | 188/189 |
| 5,096,020 | A * | 3/1992 | Korhonen | 187/376 |
| 5,301,773 | A * | 4/1994 | Jamieson et al. | 187/376 |
| 5,782,319 | A | 7/1998 | Woodruff et al. | |
| 5,937,973 | A | 8/1999 | Liebetrau | |

FOREIGN PATENT DOCUMENTS

EP 81212 A * 6/1983

OTHER PUBLICATIONS

Patent Abstracts of Japan, pub. No. 09240952, Sep. 16, 1997, "Safety Device of Elevator", Toshiba Corp.
Patent Abstracts of Japan, pub. No. 2000219450, Aug. 8, 2000, "Elevator Device", Toshiba Elevator Co Ltd.

* cited by examiner

*Primary Examiner*—Kathy Matecki
*Assistant Examiner*—Michael Lowe
(74) *Attorney, Agent, or Firm*—Schweitzer Cornman Gross & Bondell LLP

(57) ABSTRACT

A tripping device for engaging an elevator lift cage safety brake has actuating levers arranged at a rotary axle for engaging safety brake wedges of the safety braking device. Each actuating lever has a longitudinal slot matched to the diameter of the rotary axle, wherein the actuating lever is freely movable in the direction of the rotary axle and in the direction of the length of the actuating lever. A torsion spring fixes the actuating lever about the rotary axle. One spring end presses the actuating lever downwardly, wherein the movement of the actuating lever is limited by a lower abutment. The other spring end is detachably connected to a support. An upper abutment limits the movement of the actuating lever upwardly. The lower abutment and the upper abutment are each held at a respective end of a T-shaped shackle, wherein the shackle is fixedly connected to the rotary axle. The freely movable actuating levers facilitate access to the safety brake wedges of the safety braking device and prevent erroneous tripping.

12 Claims, 7 Drawing Sheets

EQUIPMENT FOR ENGAGING A SAFETY BRAKING DEVICE FOR A LIFT CAGE

The invention relates to a device for engaging a safety braking device for a lift cage, and particularly to a tripping device for incorporation in an elevator system having a speed limiter monitoring the speed of the lift cage connected by means of a support cable with a counterweight, wherein the movement of the lift cage or the counterweight is transmitted by means of a limiter cable to the speed limiter, which initiates stopping of the lift installation in the case of excess speed. The tripping device engages the safety braking device and is actuable by means of the limiter cable.

BACKGROUND OF THE INVENTION

A safety braking device which is arranged at a lift cage and by means of which the lift cage can be arrested in the case of excess speed has become known from U.S. Pat. No. 5,782,319. A speed limiter monitors the speed of the lift cage, wherein the lift cage drives a limiter cable guided over the speed limiter. In the case of excess speed of the lift cage, the speed limiter blocks the limiter cable. The blocked limiter cable trips the safety braking device by means of a lever mechanism, whereby safety brake wedges are pressed by means of a spring force against the guide rail. The thus-arising frictional force arrests the lift cage. The safety brake wedges are moved upwardly, when tripped, by means of actuating levers arranged on an axle of the lever mechanism, wherein the safety brake wedges come into contact with the guide rail and are further moved in the housing of the safety braking device by the friction force between safety brake wedge and guide rail.

A disadvantage of the known equipment resides in the fact that stopping of the lift cage can also take place when no need exists. Moreover, the actuating levers are obstructive during demounting of the safety brake wedges.

BRIEF DESCRIPTION OF THE INVENTION

The invention, avoids disadvantages of known equipment and provides a device that stops the lift cage only in the case of emergency and which is simple to maintain.

The invention is a tripping device that comprises a rotary axle which is associated with safety braking device for the lift cage upon which freely movable actuating levers are mounted. The actuating levers are arranged and constructed to actuate safety brake wedges of the associated safety braking device upon rotation of the rotary axle. The actuating lever may have means to allow the lever to be freely movable both about the rotary axle and in a direction of a length of the actuating lever. Bias means, such as a torsion spring, may be arranged at the rotary axle for fixing the actuating lever.

The tripping device may also include lower and upper stops or abutments for limiting movement of the actuating lever. The abutments may be mounted to the rotary axle. At least one safety switch for monitoring the position of the actuating lever may also be provided. A contact plate can be used to transmit movement of the actuating lever to actuate the safety switch.

The advantages achieved by the invention are essentially to be seen in the fact that the safety braking device is not unnecessarily tripped by the inertia of the limiter cable. This is of benefit, as release of the lift cage from an arrested state requires considerable effort. In addition, the wedges of the safety braking device can damage the guide rails. While unwanted actuation is minimized, stopping of the lift cage in the case of emergency is still ensured. In addition, the actuating levers arranged at the axle to be freely movable permit a simple demounting of the safety brake wedges. Moreover, the freely movable actuating levers automatically adapt to different widths of the guide limb of the guide rail. The mechanical decoupling of the actuating levers from the axle (freely movable actuating levers) is of significance particularly for high speeds of the lift cage. Faulty trippings of the safety braking device would have serious mechanical consequences for the lift cage and the guide rails.

BRIEF DESCRIPTION OF THE DRAWINGS

The present invention is explained in more detail in the following detailed description with the accompanying figures, in which.

DETAILED DESCRIPTION OF THE INVENTION

Figure 1:
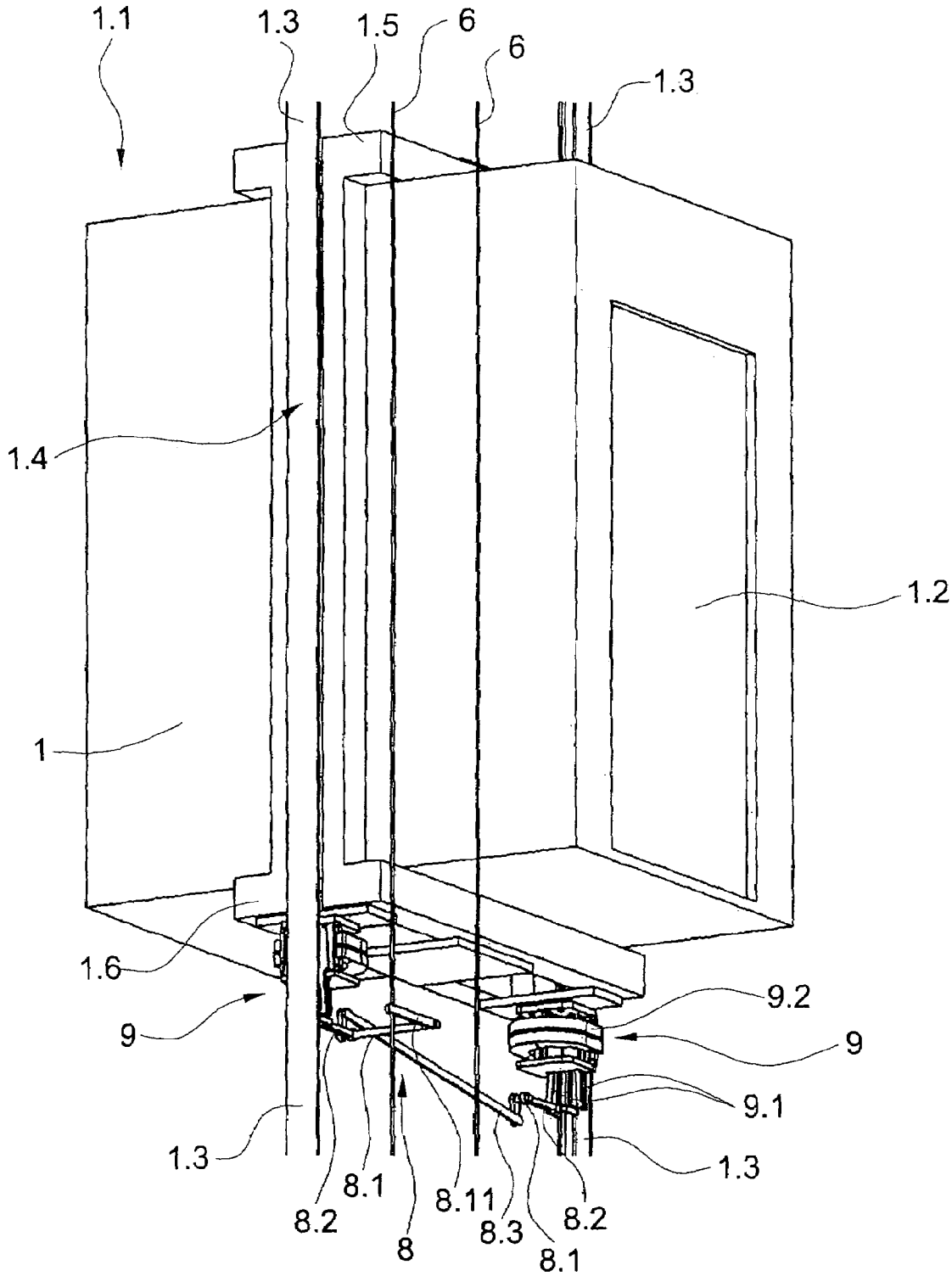
FIG. 1 is a schematic perspective view of a lift cage with the equipment according to the invention for stopping the lift cage.

A lift cage which is movable in a lift shaft 1.1 and is connected with a counterweight by means of a support cable guided over a drive pulley is denoted by 1 in FIG. 1. The drive pulley, support cable and counterweight are not illustrated. A cage door 1.2 closes the lift cage 1. Guide rails 1.3 guide the lift cage 1 during its travel. A speed limiter, which is not illustrated and which may operate on the pendulating lever principle, is, for example, provided for monitoring the speed of the lift cage 1 or counterweight, wherein the movement of the lift cage 1 or the counterweight is transmitted by means of a limiter cable 6 to the speed limiter. Limiters operating on, for example, the centrifugal force principle or the mass inertia principle can also be used for the speed monitoring. The limiter cable 6 extends over the entire shaft height and is deflected at the lower shaft end by means of a deflecting roller and tensioned by means of a tensioning weight, and is guided at the upper shaft end by way of a cable pulley of the speed limiter. The ends of the limiter cable 6 are fastened to a tripping mechanism 8 which is arranged at the lift cage 1 and which, in an emergency, actuates a safety braking device 9 arranged at the lift cage 1. In the case of excess speed of the lift cage 1 in downward direction the limiter cable 6 is blocked, which initiates actuation of the tripping mechanism 8.

The lift cage 1 is carried by a support frame 1.4 with a lower yoke 1.6 and an upper yoke 1.5, wherein the support cable guided over the drive pulley (not illustrated) is connected at one end to the upper yoke 1.5 and at the other end to the counterweight (not illustrated). At the lower yoke 1.6 a respective safety braking device 9 is arranged for each guide rail 1.3 to stop the lift cage 1 in the case of emergency. The lift cage 1 drives, by means of the limiter cable 6, the cable pulley of the speed limiter, which in the case of a specific excess speed of the lift cage 1 in the downward direction trips the cable brake and blocks. The cable brake and the block speed limiter also block the limiter cable 6 guided over the deflecting roller arranged in the shaft pit, but the lift cage 1 moves further downwardly, causing the blocked limiter cable 6 connected with the tripping mechanism 8 to engage the safety braking device 9.

The tripping mechanism 8 connected with the limiter cable 6 consists of a first rotary axle 8.1 with tripping lever 8.11 connected to the limiter cable, having actuating levers 8.2 engaging the safety brake 9. The rotary axle 8.1 of the actuating lever 8.2 for the opposite safety braking device 9 is actuated by means of a connecting rod 8.3 between the two rotary axles 8.1. When the limiter cable 6 is blocked the rotary axles 8.1 rotate in a clockwise sense as seen from the cage door 1.2. The free ends of actuating levers 8.2 are raised, which in turn move safety brake wedges 9.1 of the safety braking devices 9 upwardly, wherein the safety brake wedges 9.1 come into contact with the guide rail 1.3 and are further moved by the friction force between safety brake wedges and guide rails in the housing of the safety braking device 9. On standstill of the lift cage 1, the safety brake wedges 9.1 are acted on by spring forces of the spring packet 9.2 of the safety braking device 9.

Figure 2:
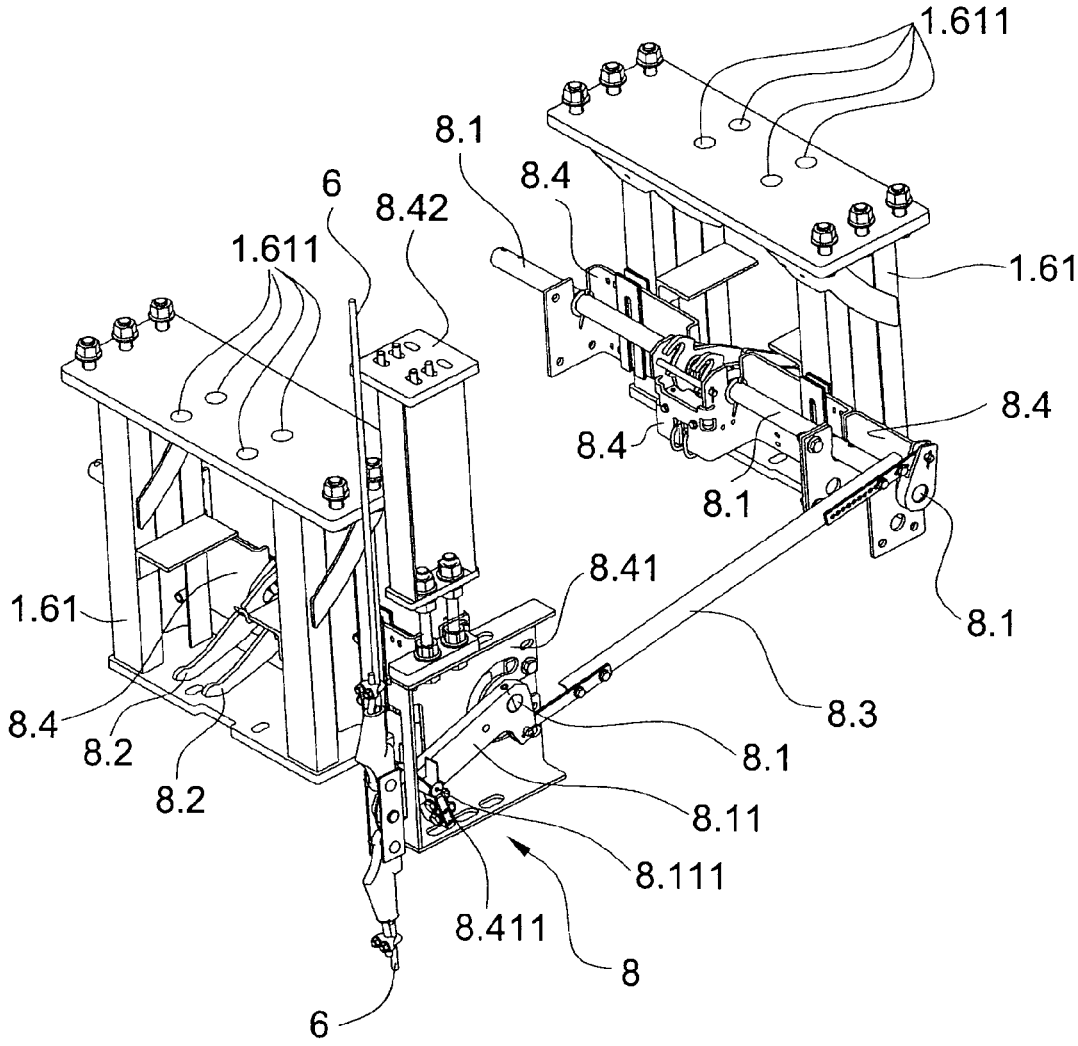
FIG. 2 is a perspective view of the essential details of a tripping mechanism, which is actuable by means of a limiter cable, for engaging a safety braking device.

FIG. 2 shows the essential details of the tripping mechanism 8, which is actuable by means of the limiter cable 6, for engaging the safety braking devices 9. A frame 1.61 arranged at the lower yoke 1.6 has bores 1.611 which serve for fastening of the safety braking device 9. In addition, a respective support 8.4 for mounting the rotary axle 8.1 is arranged at each frame 1.61 by means of plates 8.43 and screws 8.44 at the frame 1.61.

On the limiter cable side a box 8.41 mounted by a bracket 8.42 is arranged at the support of the limiter cable side support 8.4 and accommodates the tripping levers 8.11, the end of the rotary axle 8.1, the end of the connecting rod 8.3 and a detent spring 8.411. The detent spring 8.411 fixes a bolt 8.111 of the tripping lever 8.11 by a specific force which prevents erroneous tripping of the safety braking device 9. When the spring force is exceeded the bolt 8.111 leaves the detent spring 8.411, wherein the safety braking device 9 is engaged by means of the tripping lever 8.11, the rotary axle 8.1 and the actuating lever 8.2.

Figure 3:
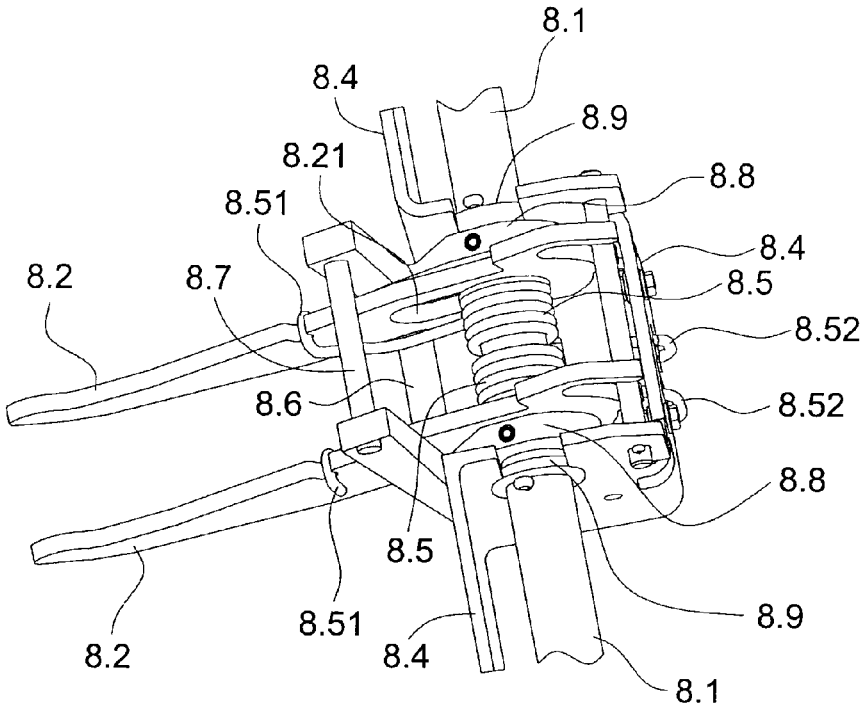
FIG. 3 is a detailed perspective view of an actuating assembly'
Figure 4:
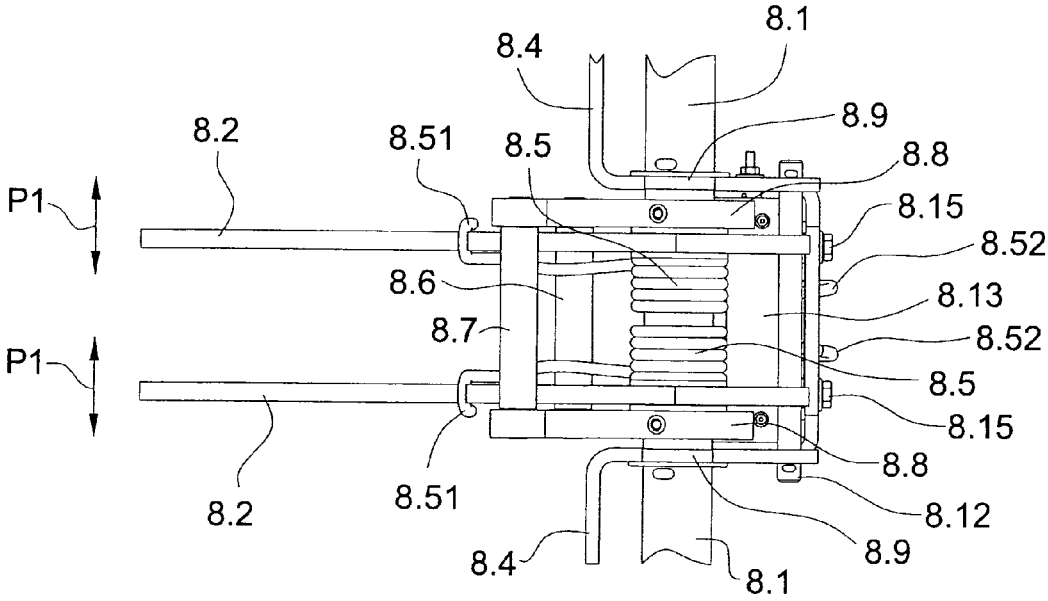
FIG. 4 is a detail plan view of the actuating lever assembly.

FIG. 3 and FIG. 4 show details of the arrangement of the actuating levers 8.2 at the rotary axle 8.1. Each actuating lever 8.2 has a longitudinal slot 8.21 which adapts to the diameter of the rotary axle 8.1, wherein the actuating lever 8.2 is freely movable about rotary axle 8.1 and in the direction of the length of actuating lever 8.2. A torsion spring 8.5 fixes the actuating lever 8.2 about the rotary axle 8.1. One spring end 8.51 presses the actuating lever 8.2 downwardly, wherein the movement of the actuating lever 8.2 is limited by a lower abutment 8.6. The other spring end 8.52 is detachably connected with the support 8.4. An upper abutment 8.7 limits the movement of the actuating lever 8.2 upwardly. The lower abutment 8.6 and the upper abutment 8.7 are each mounted at a respective end of a shackle 8.8, wherein the shackle 8.8 is fixedly connected with the rotary axle 8.1. The rotary axle 8.1 is mounted upon the support 8.4 by means of bushings 8.9. In FIG. 4, the automatic adaptation of the actuating levers 8.2 to different widths of the guide limb of the guide rail 9, is symbolized by arrows P1. The actuating levers 8.2 are freely movable about rotary axle 8.1 against the spring force. A locking pin 8.12, which is not illustrated in FIG. 3, but shown in FIG. 4, prevents the actuating levers 8.2 from being able to move in an uncontrolled manner in the direction of the longitudinal axis of the actuating lever 8.2 in the case of breakage of the torsion spring 8.4, and the rotary axle 8.1 from being able to move in uncontrolled manner in the case of breakage of either or both of the bushes 8.9. Moreover, a contact plate which serves for actuation of a safety switch is denoted by 8.13.

Figure 5:
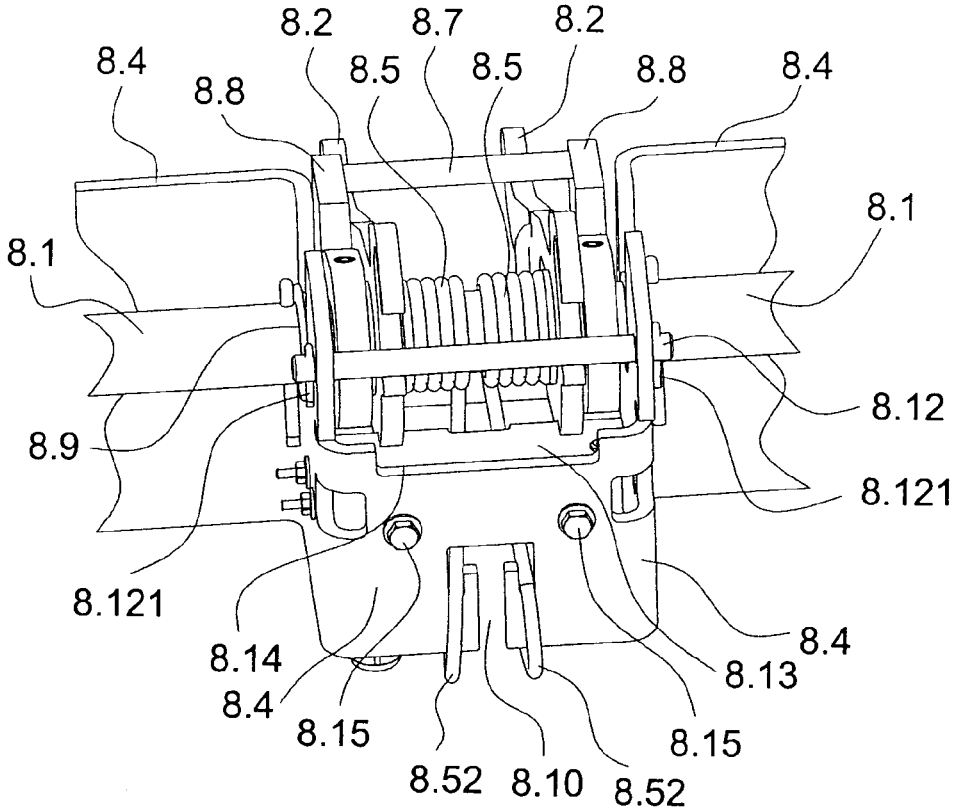
FIG. 5 is a detail perspective view of the fastening of a spring end to a support.

FIG. 5 shows details of the fastening of the spring ends 8.52 to the support 8.4. The support 8.4 has a T-shaped cut-out 8.10 with a vertical and horizontal limb. In the illustrated position of a spring end 8.52 the torsion spring 8.5 is biased, wherein the spring end 8.52 is held by the horizontal limb of the cut-out 8.10. By releasing the spring end 8.52 from the horizontal limb of the cut-out 8.10 the bias of the torsion spring 8.5 is cancelled. The corresponding spring end 8.51 can now be released from the actuating lever 8.2 and the actuating lever 8.2 be moved along its longitudinal slot 8.21 rearwardly or into a cut-out 8.14 when the locking pin 8.12, secured by means of split pins 8.121, is removed. With the actuating lever 8.2 pushed back, the safety brake wedge 9.1 is readily accessible.

Figure 6:
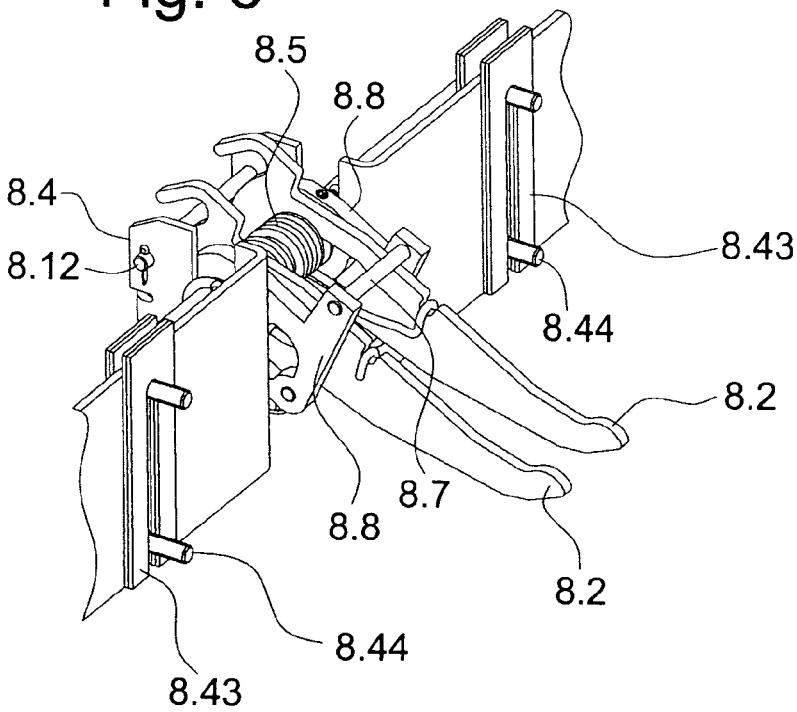
FIG. 6 is a detail perspective view of the actuating levers in the starting position.

FIG. 6 shows the actuating levers 8.2 in the starting position. The actuating levers 8.2 rest on the lower abutment 8.6, wherein the shackles 8.8, fixedly connected with the rotary axle 8.1, are pivoted downwardly.

Figure 7:
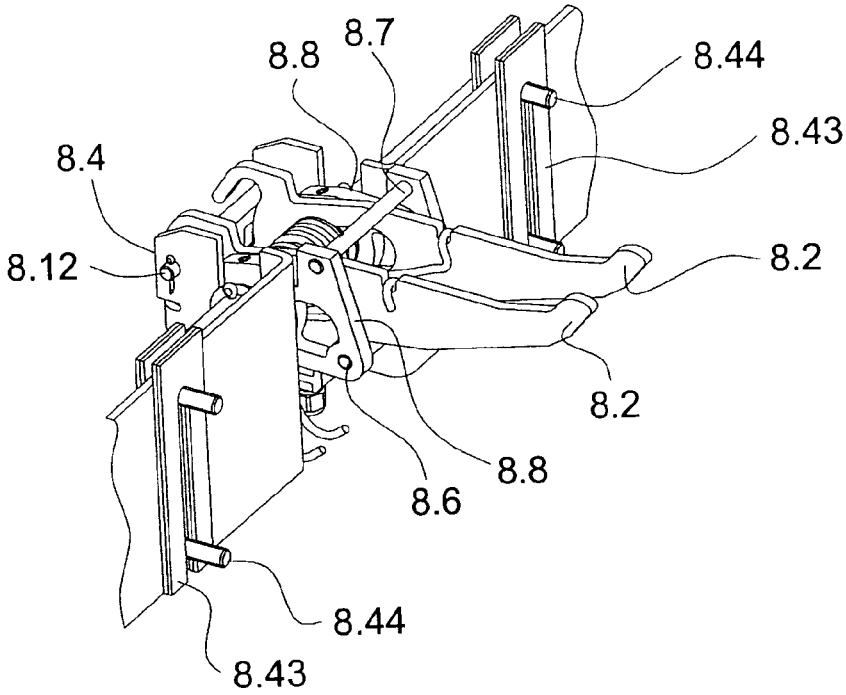
FIG. 7 is a similar view of the actuating levers in the safety braking position.

FIG. 7 shows the actuating levers 8.2 in the safety braking position, wherein the shackles 8.8 have been pivoted upwardly by means of the rotary axle 8.1 and the actuating levers 8.2, moved upwardly by means of the lower abutment 8.6, have engaged the safety brake wedges 9.1.

Figure 8:
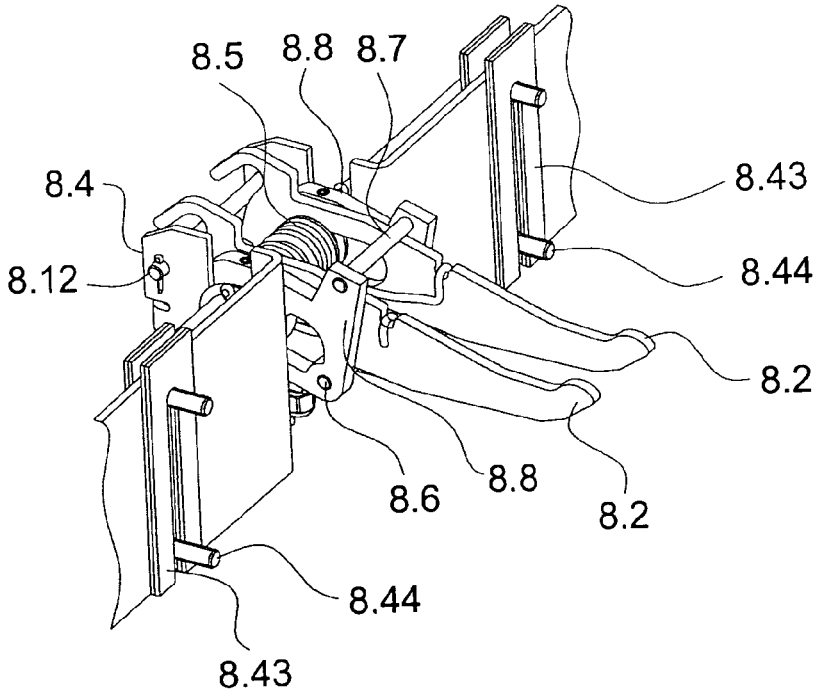
FIG. 8 is a similar view of the actuating levers in the erroneous tripping position.

FIG. 8 shows the actuating levers 8.2 in the erroneous tripping position in which the shackles 8.8, together with the lower abutment 8.6 and the upper abutment 8.7, are in the starting position. The freely movable actuating levers 8.2 have been pivoted upwardly by an external force, wherein the movement is limited by the upper abutment 8.7. In the erroneous tripping position the safety brake wedges 9.1 are not engaged.

Figure 9:
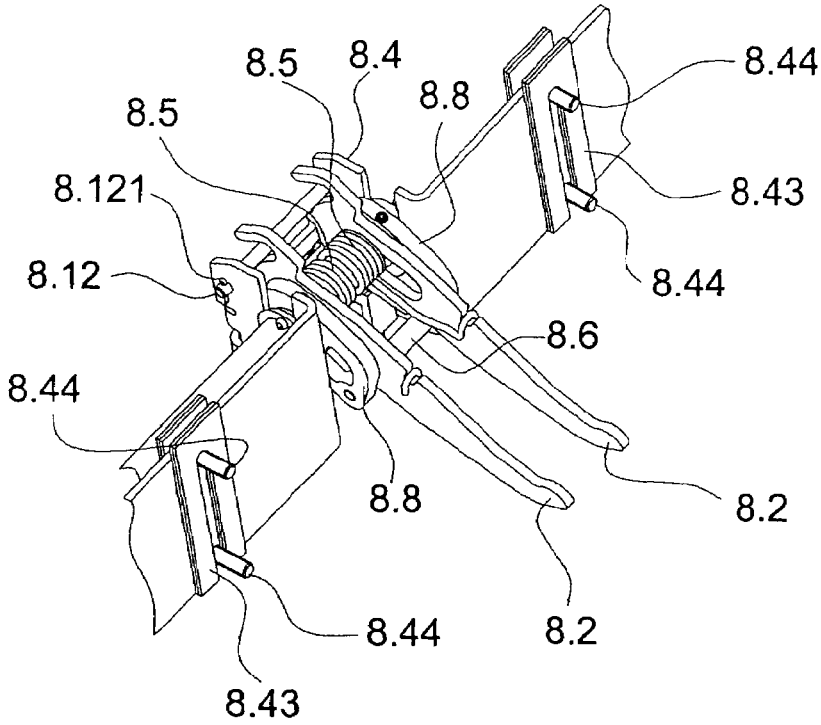
FIG. 9 is a perspective view of an alternate embodiment of the tripping mechanism.

FIG. 9 shows an embodiment of the shackles 8.8 with the lower abutment 8.6, but without the upper abutment 8.7. Without the upper abutment 8.7 the deflection of the actuating levers 8.2 upwardly is not limited. The actuating lever 8.2 is detachably connected in mechanically positive manner with a safety brake wedge 9.1. If a safety brake wedge 9.1 engages automatically, the associated actuating lever 8.2 is deflected upwardly without the rotary movement being transmitted to the adjacent actuating lever 8.2 and to the rotary axle 8.1. Loading of the connecting rod 8.3 with force is thereby prevented. A force loading would result in bowing of the connecting rod.

Figure 10:
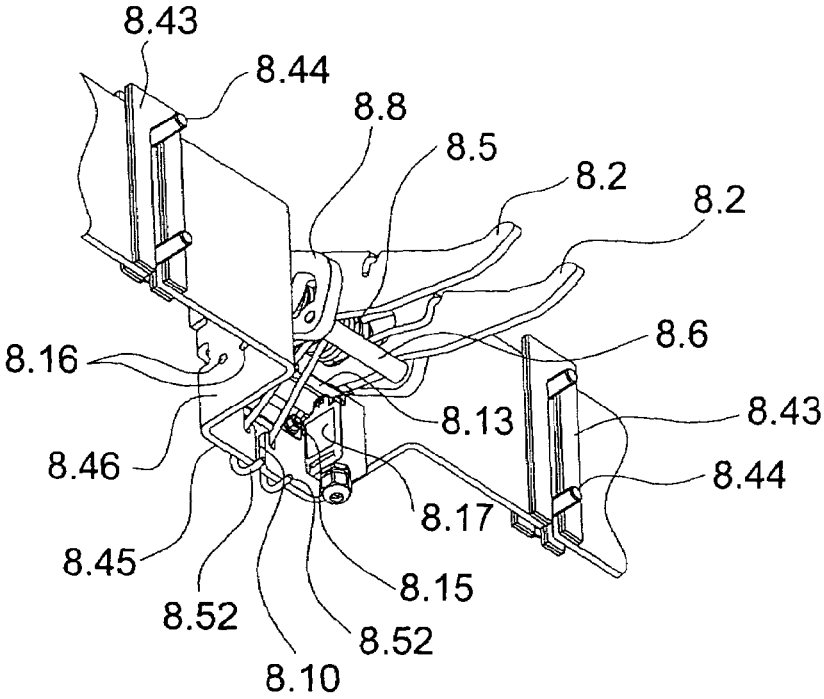
FIG. 10 is a perspective view of a device for monitoring the position of the actuating levers.

FIG. 10 shows the contact plate 8.13 for monitoring the position of the actuating levers 8.2. The contact plate 8.13 is arranged along the support rear wall 8.45 by means of bolts 8.15 at the support rear wall 8.45 below the actuating levers 8.2. Bores 8.16, which serve for fastening the safety switch, are provided at the support side wall 8.46.

Figure 11:
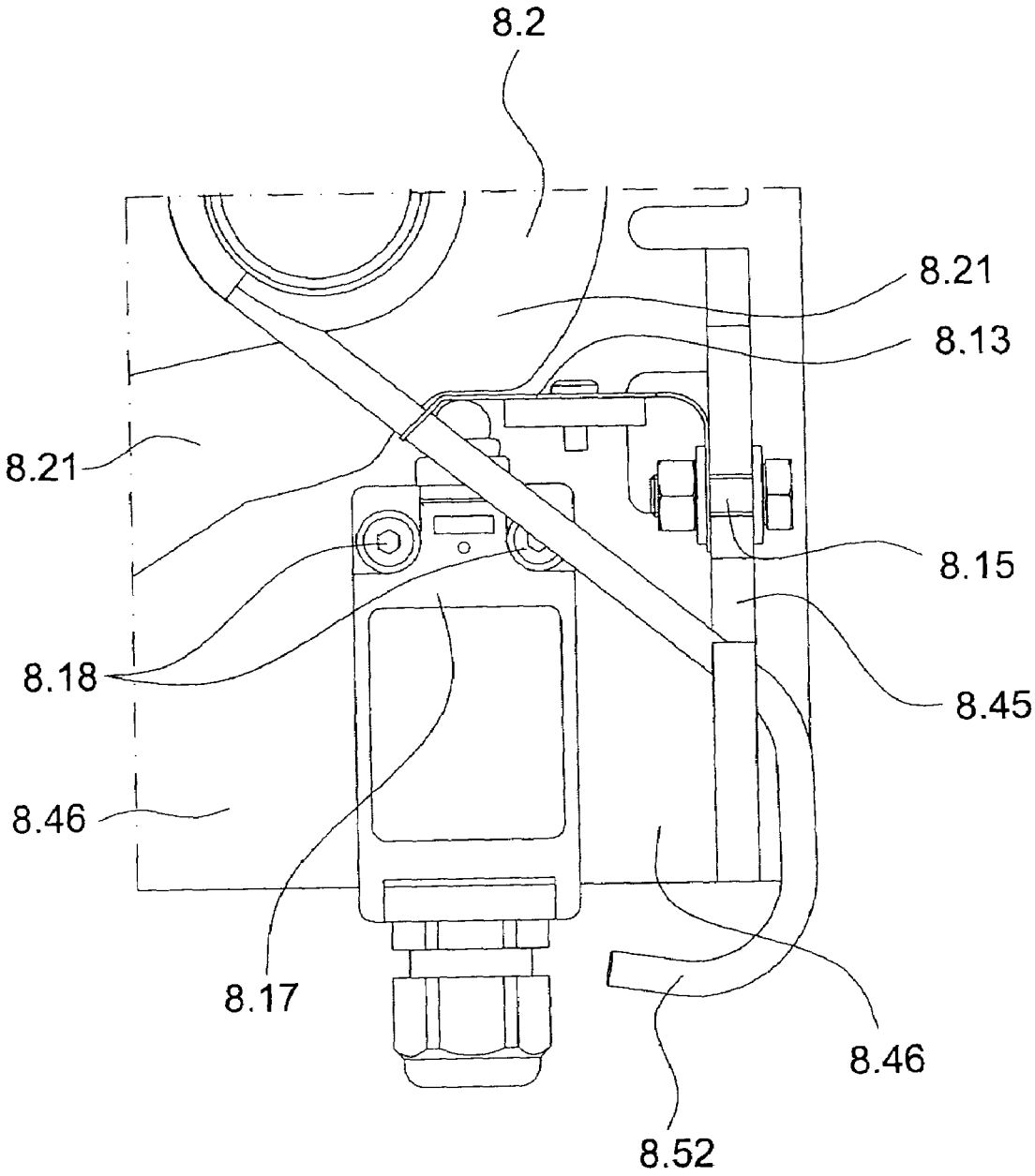
FIG. 11 is a detail plan view of the device of FIG. 10.

FIG. 11 shows further details of the device according to FIG. 10. A safety switch 8.17 is arranged, by means of bolts

8.18 through the bores 8.16, at at least one support side wall 8.46. The contact plate 8.13 is actuated by means of a dog 8.21 of an actuating lever 8.2, wherein the movement of the contact plate 8.13 is transmitted to the safety switch 8.17. The safety switch 8.17 is actuated if the actuating lever 8.2 is moved along the longitudinal slot 8.21 rearwardly or into the cut-out 8.14, or if the actuating lever 8.2 is in the safety braking position.

We claim:

1. A tripping device for engaging at least one elevator lift cage safety braking device upon actuation by a limiter cable, the elevator having a speed limiter monitoring a speed of the lift cage connected by means of a support cable with a counterweight, wherein movement of the lift cage or the counterweight is transmitted by means of the limiter cable to the speed limiter which initiates stopping of the lift cage in the case of excess speed, the tripping device comprising a rotary axle associated with each safety braking device and a plurality of actuating levers mounted in a freely movable manner with respect to the rotary axle upon the rotary axle and coupled thereto actuate safety brake wedges of the safety braking device upon rotation of the rotary axle.

2. The tripping device according to claim 1, wherein'each of the actuating levers have a longitudinal slot matched to a diameter of the rotary axle, whereby the actuating levers are freely movable about the rotary axle and in a direction of a length of the actuating levers.

3. The tripping device according to claim 1 or 2, further comprising a torsion spring arranged at the rotary axle for fixing the actuating levers.

4. The tripping device according to claim 3, wherein the torsion spring has a first spring end is detachably affixed to one of the actuating levers and a second spring end detachably affixed to a support for the rotary axle.

5. The tripping device according to claim 3, further comprising a lower abutment for limiting downward movement of the actuating levers, wherein the lower abutment has ends held by a respective shackle which is fixedly connected with the rotary axle.

6. The tripping device according to claim 5, further comprising an upper abutment for limiting upward movement of the actuating levers, wherein the upper abutment has ends held by the respective shackle fixedly connected with the rotary axle.

7. The tripping device according to claim 1 or 2, further comprising a lower abutment for limiting downward movement of the actuating levers, wherein the lower abutment has ends held by a respective shackle which is fixedly connected with the rotary axle.

8. The tripping device according to claim 7, further comprising an upper abutment for limiting upward movement of the actuating levers, wherein the upper abutment has ends held by the respective shackle fixedly connected with the rotary axle.

9. The tripping device according to claim 7, further comprising at least one safety switch for monitoring the position of the actuating'levers arranged at a support.

10. The tripping device according to claim 9, further comprising a contact plate located to transmit movement of an the actuating'levers to actuate the safety switch.

11. The tripping device according to claim 1 or 2, further comprising at least one safety switch for monitoring the position of the actuating levers arranged at a support.

12. The tripping device according to claim 11, further comprising a contact plate located to transmit movement of the actuating levers to actuate the safety switch.

* * * * *